US008403702B2

(12) United States Patent
Lopes et al.

(10) Patent No.: US 8,403,702 B2
(45) Date of Patent: Mar. 26, 2013

(54) RELEASABLE ELECTRICAL CONNECTOR ADAPTOR AND ASSEMBLY

(75) Inventors: Ednei Lopes, Braganca Paulista (BR); Jose Roberto Goldschmidt, Campinas (BR); Aguinaldo Vicenza, Braganca Paulista (BR)

(73) Assignee: Tyco Electronics Brasil Ltda., Sao Paulo (BR)

( * ) Notice: Subject to any disclaimer, the term of this patent is extended or adjusted under 35 U.S.C. 154(b) by 0 days.

(21) Appl. No.: 13/166,380

(22) Filed: Jun. 22, 2011

(65) Prior Publication Data

US 2012/0329304 A1 Dec. 27, 2012

(51) Int. Cl.
*H01R 13/40* (2006.01)

(52) U.S. Cl. ..... 439/595

(58) Field of Classification Search ..... 439/752, 439/595, 358, 353, 354, 329, 567
See application file for complete search history.

(56) References Cited

U.S. PATENT DOCUMENTS

| | | | | | |
|---|---|---|---|---|---|
| 4,124,264 | A * | 11/1978 | Kato et al. | ..... | 439/595 |
| 4,752,251 | A * | 6/1988 | Kato et al. | ..... | 439/752 |
| 5,030,116 | A | 7/1991 | Sakai et al. | | |
| 5,350,316 | A * | 9/1994 | Van Wagener et al. | ..... | 439/460 |
| 5,433,626 | A * | 7/1995 | Drewanz et al. | ..... | 439/404 |
| 5,575,683 | A * | 11/1996 | Saito et al. | ..... | 439/595 |
| 2002/0102878 | A1 * | 8/2002 | Murakami | ..... | 439/595 |

* cited by examiner

*Primary Examiner* — Neil Abrams
*Assistant Examiner* — Phuongchi Nguyen

(57) ABSTRACT

Disclosed is an electrical connector adaptor, an electrical assembly, and a process of connecting an electrical assembly. The electrical connector adaptor includes a housing, a mechanical latch positioned on the housing, terminals arranged and disposed within the housing, and a terminal retention device configured to retain the terminals within the housing. The mechanical latch is configured to releasably secure the housing to a first electrical connector. The electrical connector adaptor permits electrical connection between the first electrical connector and a second electrical connector, the first electrical connector and the second electrical connector being otherwise incompatible.

19 Claims, 3 Drawing Sheets

RELEASABLE ELECTRICAL CONNECTOR ADAPTOR AND ASSEMBLY

FIELD OF THE INVENTION

The present invention is directed to electrical connector adaptors, assemblies, and processes of connecting. More specifically, the present invention relates to releasable electrical connector adaptors, electrical assemblies having releasable electrical connector adaptors, and processes of connecting electrical assemblies having releasable electrical connector adaptors.

BACKGROUND OF THE INVENTION

Electrical connector adaptors are used for various applications to provide mechanical and electrical connections for electrical connectors, such as wiring harnesses and equipment receptacles. Electrical connector adaptors can be used in electrical systems, for example, for vehicle systems, electric tools, control systems, or other suitable electrical products. Such electrical connector adaptors house and protect terminals from environmental conditions such as temperature extremes and/or environmental substances such as dirt or moisture.

Known electrical connector adaptors suffer from a drawback that instead of being constructed as a one-piece adaptor, they are typically a two-piece set of mating connector adaptors (male housing and female housing assembled by a cable) used to make a single connection between electrical connectors. Each housing can contain electrical terminals and a terminal position device for securing the terminals inside the housing. The mating connectors can include a clip configured to engage the equipment receptacle, thus loosely attaching the mating connectors to the receptacle. Such connectors suffer from a drawback that they do not permit desired adaptation, for example, when dealing with features common to one region such as a country or continent.

Electrical connector adaptors can be subject to a great deal of vibration and heat stress that tend to work loose connections and fatigue the electrical terminals. Thus, the ability to provide an electrical connector adaptor with durable structure to releasably secure the connector adaptor to the equipment and integral means to releasably secure the electrical terminals inside the housing is desirable.

An electrical connector adaptor, an electrical assembly, and a process that is capable of releasably securing that do not suffer from one or more of the above drawbacks would be desirable in the art.

BRIEF DESCRIPTION OF THE INVENTION

In an exemplary embodiment, an electrical connector adaptor includes a housing, a mechanical latch positioned on the housing, terminals arranged and disposed within the housing, and a terminal retention device configured to retain the terminals within the housing. The mechanical latch is configured to releasably secure the housing to a first electrical connector. The electrical connector adaptor permits electrical connection between the first electrical connector and a second electrical connector, the first electrical connector and the second electrical connector being otherwise incompatible.

In another exemplary embodiment, an electrical assembly includes a first electrical connector and an electrical connector adaptor configured to releasably engage the electrical connector. The electrical connector adaptor includes a housing, a mechanical latch positioned on the housing, terminals disposed within the housing, and a terminal retention device configured to engage the housing. The terminal retention device secures the terminals within the housing. The mechanical latch is configured to releasably secure the housing to the first electrical connector. The electrical connector adaptor permits electrical connection between the first electrical connector and a second electrical connector, the first electrical connector and the second electrical connector being otherwise incompatible.

In another exemplary embodiment, a process of connecting an electrical assembly includes positioning an electrical connector adaptor proximal to a first electrical connector and engaging the electrical connector adaptor with the first electrical connector, thereby releasably securing the housing with the mechanical latch. The electrical connector adaptor includes a housing, a mechanical latch positioned on the housing, terminals arranged and disposed within the housing, and a terminal retention device configured to engage the housing. The terminal retention device secures the terminals within the housing.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

Wherever possible, the same reference numbers will be used throughout the drawings to represent the same parts.

DETAILED DESCRIPTION OF THE INVENTION

Provided is an exemplary electrical connector adaptor, an electrical assembly, and a process of connecting an electrical assembly. Embodiments of the present disclosure permit an electrical connector adaptor to operatively connect two electrical connectors or an electrical connector and an equipment receptacle both structurally and electrically, permit terminal position assurance, permit quick alignment and releasable connection with the two electrical connectors, an ability to replace terminals, permits audible confirmation of proper connecting, permit releasable securing of electrical terminals positioned inside a connector housing, include hybrid parts such as terminals that are male and female at different spacing permitting interchangeability, permit safe and/or clean engagement, permit a greater variety of designs and applications to be connected, and combinations thereof.

Figure 1:
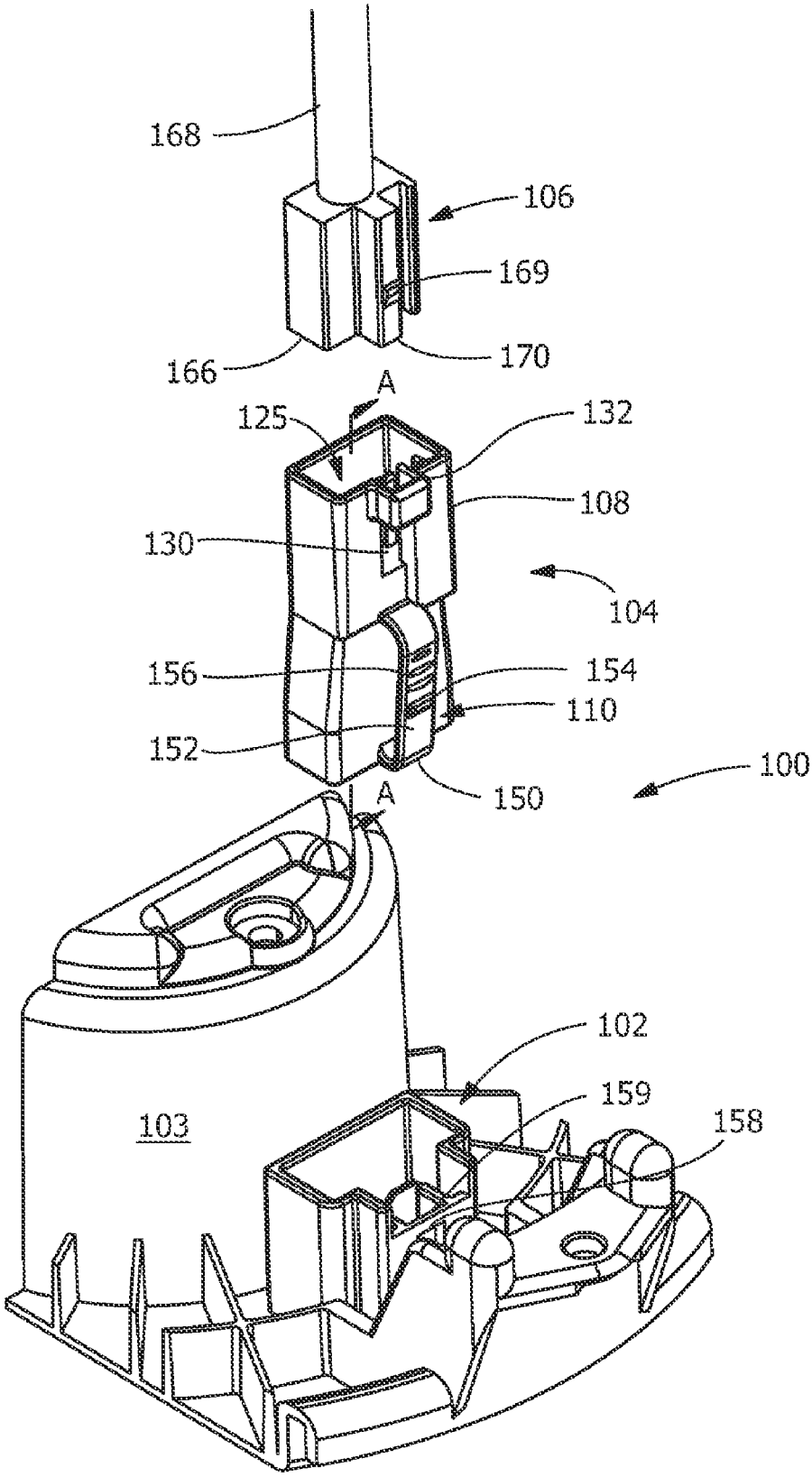
FIG. 1 is an exploded perspective view of an exemplary electrical connector assembly according to the disclosure.
Figure 2:
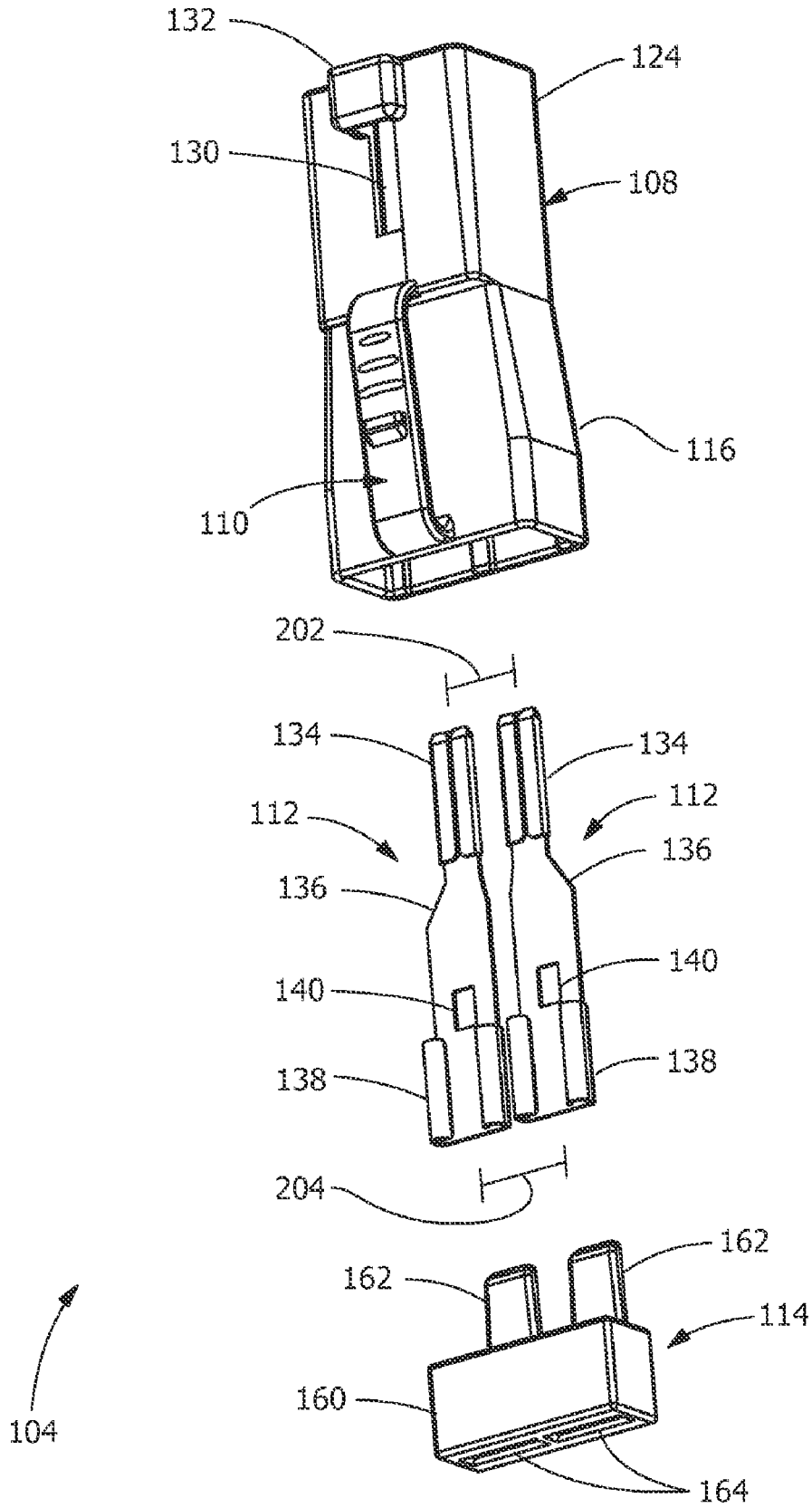
FIG. 2 is an exploded front perspective view of an exemplary electrical connector adaptor according to the disclosure.

Referring to FIG. 1, in one embodiment, an exemplary electrical connector assembly 100 includes an equipment receptacle 102 and an electrical connector adaptor 104 configured to releasably engage the equipment receptacle 102. Referring to FIG. 2, in one embodiment, the electrical connector adaptor 104 further includes a housing 108, a mechanical latch 110, one or more electrical terminals 112, and a terminal retention device 114 configured to engage the adaptor housing 108. The adaptor housing 108 is any suitable housing structure capable of structural and electrical connection to equipment receptacle 102. In one embodiment, the adaptor housing 108 is fabricated of polymeric or other durable material, such as Acrylonitrile Butadiene Styrene (ABS), Polyamide (PA), Polyamide 66 (PA66), Polybutylene Terephthalate (PBT), Polycarbonate (PC), Polypropylene (PP), and combinations thereof. The adaptor housing 108 extends around of the terminals 112 and protects them from exposure to the environment. The adaptor housing 108 is any suitable geometry, for example, complex partially cylindrical, having a cylindrical interior but a non-cylindrical exterior, cuboid, or combinations thereof.

As shown in FIG. 1, in one embodiment, the electrical connector assembly 100 includes a first electrical connector, such as the equipment receptacle 102, the electrical connector adaptor 104 configured to releasably engage the equipment receptacle 102, and a second electrical connector, such as a wiring harness 106. The electrical connector adaptor 104 permits electrical connection between the first electrical connector and the second electrical connector, the first electrical connector and the second electrical connector being otherwise incompatible. The first and/or second electrical connectors are any suitable electrical connectors. Suitable electrical connectors include, but are not limited to, for example, equipment receptacles, wiring harnesses, plugs, cable connectors, machine and equipment connectors manufactured in different countries and/or companies, machine and equipment connectors manufactured with different design specifications, special connectors, and combinations thereof.

In one embodiment, the wiring harness 106 is configured to releasably engage the electrical connector adaptor 104. The wiring harness 106 receives electrical power and/or electrical signals from a power source (not shown), a controller (not shown), and/or other electrical systems (not shown), such as a vehicle electrical system, and transmits the power and/or electrical signals through the electrical connector adaptor 104 to the equipment receptacle 102. In one embodiment, the wiring harness 106 includes a cable portion 168 and a plug portion 166, with the cable portion 168 configured to electrically communicate with the vehicle power source (not shown), the controller (not shown), and/or the other electrical systems (not shown). The plug portion 166 includes a front clip 170 and a plurality of female receptacles within (not shown). The plug portion 166 is inserted into a recess 125 of the adaptor 104 such that the receptacles of the plug portion 166 are aligned with and adjacent to corresponding terminals 112 of the adaptor 104. The front clip 170 of the plug portion 166 includes a tab 169 configured to engage a retainer 132 of the adaptor housing 108. The front clip 170 engages a front slot 130 and the retainer 132 of the adaptor housing 108 to secure the wiring harness 106 with the adaptor housing 108. The clip 170 is configured for deflection to disengage tab 169 from the retainer 132, allowing for removal of the plug portion 166. In one embodiment, the equipment receptacle 102 transmits the power and/or electrical signals to associated equipment 103, such as a vehicle blower motor, or other suitable device within the electrical connector adaptor 104.

Figure 3:
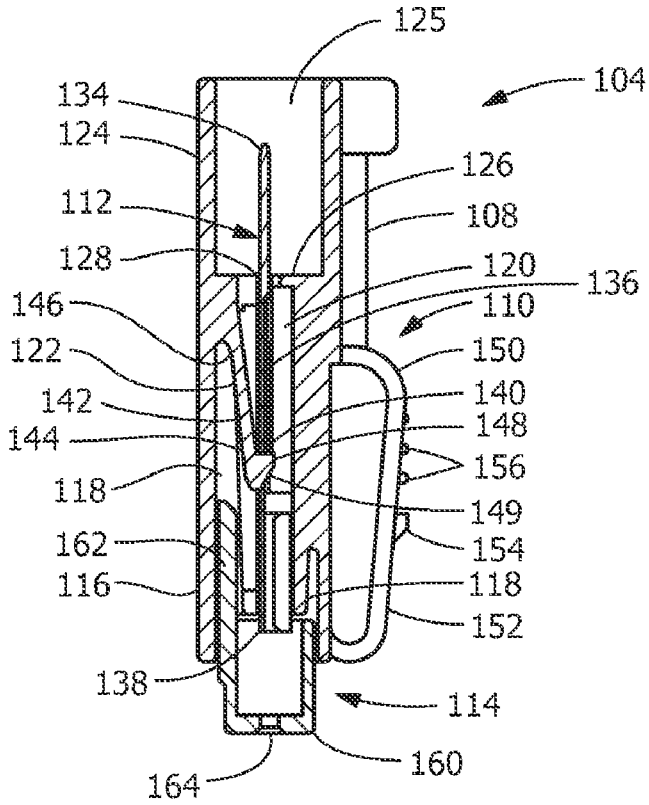
FIG. 3 is a section view of an exemplary electrical connector adaptor along line AA of FIG. 1 according to the disclosure with the terminal retention device in an unlocked position.

Referring to FIGS. 1 and 3, in one embodiment, the mechanical latch 110 positioned on the adaptor housing 108 includes an elongated strap 150 with a front face 152 configured with one or more projections 154 and one or more grips 156. The strap 150 is connected at each end to the exterior of the adaptor housing 108. The projection 154 is configured to cooperate with a receptacle opening 158 in the side wall of the equipment receptacle 102 to secure the electrical connector adaptor 104 within the equipment receptacle 102. The projection 154 includes a beveled geometry to ease insertion of the electrical connector adaptor 104 into the equipment receptacle 102. As the electrical connector adaptor 104 is inserted into the equipment receptacle 102, a feature 159 above opening 158 deflects the elongated strap 150 toward the adaptor housing 108. Once the projection 154 reaches the receptacle opening 158 of the equipment receptacle 102, the elongated strap 150 springs toward the receptacle opening 158 to secure the electrical connector adaptor 104 in a locked position within the equipment receptacle 102.

In one embodiment, the mechanical latch 110 is capable of being manually deflected and deformed, whereby the strap 150 deflects back toward the adaptor housing 108 by pressing against grips 156. The strap 150 is configured to deflect to a position to allow projection 154 to disengage from opening 158. Once projection 154 clears the opening 158, the electrical connector adaptor 104 can be lifted up and moved out of equipment receptacle 102, being in the unlocked position. In another embodiment, a tool is inserted through opening 158 to depress the projection 154 and release the mechanical latch 110, permitting removal of the electrical connector adaptor 104 from the equipment receptacle 102.

As shown in FIG. 2, in one embodiment, the adaptor housing 108 of the electrical connector adaptor 104 includes a receptacle portion 116 configured as a male structure to engage the equipment receptacle 102 (see FIG. 1) and a cable portion 124 configured as a female structure to engage the wiring harness 106 (see FIG. 1) or a plug. The cable portion 124 of housing 108 includes the front slot 130 and the retainer 132 configured to engage the wiring harness 106. In another embodiment, the receptacle portion 116 is configured as a female structure to engage the equipment receptacle 102, and the cable portion 124 is configured as a male structure to engage the wiring harness 106.

In one embodiment, the connector adaptor 104 further includes the terminals 112 and the terminal retention device 114. The electrical terminal 112 includes the tab portion 134, a mid portion 136, and a receptacle portion 138. The mid portion 136 includes a latch opening 140 configured to engage a terminal latch 122 (see FIG. 3). The terminal retention device 114 includes a frame 160 with one or more extension arms 162 and one or more connector openings 164. The frame 160 of terminal retention device 114 is configured to be inserted into a retention channel 118 (see FIG. 3) of the receptacle portion 116 of the adaptor housing 108 and to be secured by an interference fit with the frame 160.

In one embodiment, the terminals are elongate structures having a first end, for example, a narrower end, identifiable by the tab portions 134 and a second end, for example, a broader end, identifiable by the receptacle portions 138. In one embodiment, the tab portions 134 of two adjacent terminals 112 are configured and positioned within the housing a predetermined spacing/distance apart, for example, a tab spacing 202, based upon a distance between a predetermined portion, for example, a center position, of each of the two adjacent terminals 112 at the tab portion 134 or the first end. A different predetermined spacing/distance is a receptacle spacing 204 between a center portion of each of the two adjacent terminals 112 at the receptacle portions 138 or the second end. Having the tab spacing 202 and the receptacle spacing 204 being different, the terminals 112, in one embodiment, are each asymmetric. The different spacing is based upon two components: the structure of the terminals 112 and the distance between the terminals 112. The structure component provides the versatility and/or interchangeability. In one embodiment, the tab spacing 202 is greater than the receptacle spacing 204. In another embodiment, the receptacle spacing 204 is greater than the tap spacing 202. These differences permit the terminal 112 to be used with male and/or female features, between otherwise off connectors, otherwise incompatible connectors, or combinations thereof. Such differences permit interchangeable, for example, by being capable of engaging connectors and/or receptacles of different sizes and/or of different configurations.

Figure 4:
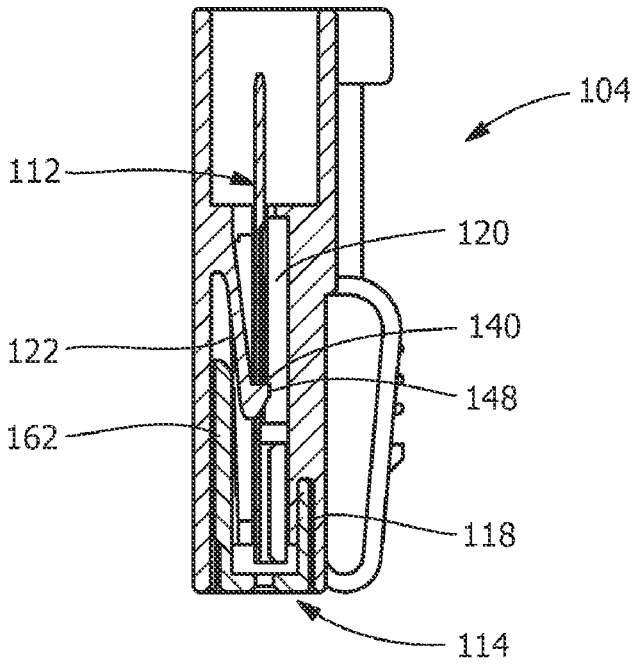
FIG. 4 is a section view of an exemplary electrical connector adaptor along line AA of FIG. 1 according to the disclosure with the terminal retention device in a locked position.

FIG. 3 shows the partially assembled adaptor 104. The terminals 112 are inserted into the housing 108 and then terminal retention device 114 is inserted into within the housing 108. The electrical terminals 112 are arranged and disposed to be inserted into a terminal passage 120 of the adaptor housing 108 through the receptacle portion 116 and are positioned to allow the tab portion 134 to protrude through terminal apertures 128 into the cable recess 125. The electrical terminals 112 are further arranged and disposed to permit the receptacle portion 138 of the terminal 112 to be positioned proximate the receptacle portion 116 of the adaptor housing 108. FIG. 4 shows the fully assembled adaptor 104 with the terminals 112 electrically coupling and the housing structurally or mechanically coupling.

As shown in FIG. 3, in one embodiment, the deflectable terminal latch 122 includes the arm or beam 142 extending longitudinally within the terminal passage 120. The arm 142 has a base portion 146 configured to connect to the interior of the adaptor housing 108, and a free standing portion 144. The arm 142 is configured to be pivoted outwardly in the terminal passage 120 to allow the terminal 112 to be inserted into the terminal passage 120. A portion of retention channel 118 extends adjacent to each of the arms 142 of the terminal latches 122. The retention channel 118 extends along the perimeter of the receptacle portion 116 of the adaptor housing 108. The free standing portion 144 of the arm 142 includes a latch head 148 configured to engage the latch opening 140 on the terminal 112. The latch head 148 of the latch arm 142 includes a beveled geometry or wedge shape on an inner face 149 to ease insertion of the terminal 112 into the terminal passage 120 during insertion.

In one embodiment, the terminal retention device 114 is moved from an unlocked position (see FIG. 3), where it is partially inserted into the channel 118, to a locked position (see FIG. 4), where it is fully inserted into the channel 118. When moving from the unlocked position to the locked position, the extension arms 162 slide behind the terminal latches 122, securing the latch heads 148 biased against the terminals 112, and the heads 148 engaged with latch openings 140. The lock position retains and substantially prevents the terminals 112 from moving laterally within terminal passage 120 as the electrical connector adaptor 104 is connected and disconnected from the equipment receptacle 102 (see FIG. 1). In addition, in one embodiment, the lock position prevents vibration from interrupting an electrical connection.

Referring to FIG. 3, showing the terminal retention device 114 prior to full insertion into the electrical connector adaptor 104, and FIG. 4, showing the terminal retention device 114 fully inserted into the electrical connector adaptor 104, in one embodiment, the electrical connector adapter 104 includes the terminal passage 120 configured to receive and support the one or more electrical terminals 112 within the adaptor housing 108. The terminal passage 120 includes one or more deflectable terminal latches 122. The terminal latches 122 are configured to engage and secure the terminals 112 within the terminal passage 120. The cable portion 124 includes the recess 125 with the wall or the cable seat 126, and the cable seat 126 includes one or more terminal apertures 128. The receptacle portion 116 includes the retention channel 118, and the retention channel 118 is configured to receive arms 162 of the terminal retention device 114, whereby the arms 162 are inserted to maintain the latch head 148 in the latch opening 140. The receptacle portion 116 of the terminal 112 connects to equipment receptacle tabs (not shown) through the connector openings 164.

As each of the terminals 112 is inserted into the terminal passage 120, the tab portion 134 of the terminal 112 engages against the inner face 149 of latch head 148 as is shown in FIG. 4. As the terminal 112 is continuously inserted, the tab portion 134 of the terminal 112 engages against the wedge geometry, gently forcing back or biasing the latch arm 142 or preventing the latch arm 142 from moving. In addition, continued inward movement of the terminal 112 biases the latch arm 142 laterally outwardly in the terminal passage 120, into a portion of the retention channel 118. The terminal 112 continues to move longitudinally inward into the terminal passage 120 until the tab portion 134 moves past the latch head 148 of the latch arm 142. Once the head 148 reaches the latch opening 140 in the mid portion 136 of the terminal 112, the latch arm 142 springs laterally inward in the terminal passage 120 to secure the terminal 112 in a locked position within the terminal passage 120.

If the terminals 112 are removable terminals to be replaced, the terminal retention device 114 is moved out of the retention channel 118 to the unlocked position, then removed from the electrical connector adaptor 104. A tool, such as, but not limited to, a pick (not shown), can be inserted through the terminal passage 120 from the direction where the terminal retention device 114 had been positioned and the tool is used to bias the terminal latch 122 outwardly so that the terminal 112 can be removed from the terminal passage 120.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. An electrical connector adaptor, comprising:

a housing;

a retainer proximate a first end of the housing, the retainer configured to releasably secure the housing to a second electrical connector;

a mechanical latch positioned on the housing proximate a second end of the housing, the mechanical latch configured to releasably secure the housing to a first electrical connector;

terminals arranged and disposed within the housing to create a first spacing between the terminals at a first end of the terminals and a second spacing of the terminals at a second end of the terminals, the first spacing differing from the second spacing; and a terminal retention device configured to retain the terminals within the housing;

wherein the electrical connector adaptor permits electrical connection between the first electrical connector and the second electrical connector, the first electrical connector and the second electrical connector being incompatible.

2. The electrical connector adaptor of claim 1, wherein the different spacing includes a tab spacing and a receptacle spacing.

3. The electrical connector adaptor of claim 1, wherein the terminals are removable.

4. The electrical connector adaptor of claim 1, wherein the housing includes a terminal passage configured to permit the terminals to be inserted into the terminal passage.

5. The electrical connector adaptor of claim 1, wherein the housing includes a retention channel configured to permit a terminal retention device to be inserted into the housing.

6. The electrical connector adaptor of claim 1, wherein the housing is configured to allow a tool to be inserted, permitting removal of the terminals.

7. The electrical connector adaptor of claim 1, wherein the mechanical latch is a deflectable latch including a projection.

8. The electrical connector adaptor of claim 1, wherein the first electrical connector is an equipment connection receptacle including an opening configured to cooperate with the mechanical latch.

9. The electrical connector adaptor of claim 1, wherein the terminal retention device includes a plurality of extension arms.

10. The electrical connector adaptor of claim 1, wherein the terminals have a tab portion at a first end and a receptacle portion at a second end.

11. The electrical connector adaptor of claim 1, wherein the housing includes one or more deflectable terminal latches, the deflectable terminal latches being configured to engage and secure the terminals.

12. The electrical connector adaptor of claim 11, wherein the deflectable terminal latches include latch arms extending longitudinally which cooperate with latch openings of the terminals.

13. An electrical assembly, comprising:

a first electrical connector;

a second electrical connector; and an electrical connector adaptor configured to releasably engage the first electrical connector and the second electrical connector, the electrical connector adaptor comprising:

a housing;

a retainer proximate a first end of the housing;

a mechanical latch proximate a second end of the housing;

terminals disposed within the housing; and a terminal retention device configured to engage the housing;

wherein the terminal retention device secures the terminals within the housing; and wherein the mechanical latch is configured to releasably secure the housing to the first electrical connector;

wherein the retainer is configured to releasably secure the housing to the second electrical connector;

wherein the electrical connector adaptor permits electrical connection between the first electrical connector and the second electrical connector, the first electrical connector and the second electrical connector being incompatible.

14. The electrical assembly of claim 13, wherein the first electrical connector is an equipment connection receptacle.

15. The electrical assembly of claim 13, wherein the housing is configured to allow a tool to be inserted, permitting removal of the terminals.

16. The electrical assembly of claim 13, wherein the housing includes a deflectable latch, the deflectable latch configured to engage and secure the terminals.

17. A process of connecting an electrical assembly, the process comprising:

positioning an electrical connector adaptor proximal to a first electrical connector and a second electrical connector, the electrical connector adaptor comprising:

a housing;

a retainer proximate a first end of the housing;

a mechanical latch proximate a second end of the housing;

terminals arranged and disposed within the housing; and a terminal retention device configured to engage the housing;

wherein the terminal retention device secures the terminals within the housing; and engaging the electrical connector adaptor with the first electrical connector, thereby releasably securing the first electrical connector to the housing with the mechanical latch;

engaging the electrical connector adaptor with the second electrical connector, thereby releasably securing the second electrical connector to the housing with the retainer.

18. The process of claim 17, wherein the first electrical connector and the second electrical connector being incompatible.

19. The process of claim 18, further comprising electrically communicating between the first electrical connector and the second electrical connector.

* * * * *